US008858026B2

(12) United States Patent
Lee et al.

(10) Patent No.: US 8,858,026 B2
(45) Date of Patent: Oct. 14, 2014

(54) LED LIGHTING SYSTEM AND HIGH-POWER LED LAMP

(75) Inventors: Kechin Lee, Zhongshan (CN); Hongchieh Chen, Zhongshan (CN)

(73) Assignee: Zhongshan Weiqiang Technology Co., Ltd., Zhongshan (CN)

( * ) Notice: Subject to any disclaimer, the term of this patent is extended or adjusted under 35 U.S.C. 154(b) by 224 days.

(21) Appl. No.: 13/492,334

(22) Filed: Jun. 8, 2012

(65) Prior Publication Data

US 2012/0313525 A1 Dec. 13, 2012

(30) Foreign Application Priority Data

Jun. 9, 2011 (CN) ..... 2011 1 0153908
Dec. 14, 2011 (CN) ..... 2011 1 0417448
Jan. 17, 2012 (CN) ..... 2012 1 0013850

(51) Int. Cl.

| | |
|---|---|
| ***F21S 4/00*** | (2006.01) |
| ***F21V 21/00*** | (2006.01) |
| ***F21V 29/00*** | (2006.01) |
| ***F28D 15/02*** | (2006.01) |
| ***F21V 23/00*** | (2006.01) |
| ***F21K 99/00*** | (2010.01) |
| *F21Y 101/02* | (2006.01) |

(52) U.S. Cl.

CPC ..... *F21V 29/2293* (2013.01); *F21V 29/006* (2013.01); *F28D 15/0275* (2013.01); *F21Y 2101/02* (2013.01); *F21V 29/2225* (2013.01); *F21V 23/003* (2013.01); *F28D 15/0233* (2013.01); *F21K 9/00* (2013.01); *Y10S 362/80* (2013.01)

USPC ..... 362/249.02; 362/294; 362/800

(58) Field of Classification Search

CPC ..... F21K 9/00; F21V 23/003–23/006; F21V 29/00; F21V 29/006; F21V 29/20; F21V 29/22; F21V 29/2206; F21V 29/2225; F21V 29/2243; F21V 29/2293; F21V 29/26; F21V 29/262; F21V 29/30; F21Y 2101/02; F28D 15/0233; F28D 15/0275

USPC ..... 362/249.02, 294, 800

See application file for complete search history.

(56) References Cited

U.S. PATENT DOCUMENTS 7,494,248 B2 * 2/2009 Li ..... 362/294

* cited by examiner

*Primary Examiner* — Jason Moon Han

(74) *Attorney, Agent, or Firm* — Hamre, Schumann, Mueller & Larson, P.C.

(57) ABSTRACT

The present invention relates to a high-power LED lamp. The lamp includes an LED module, an inner heat sink disposing air passages along an axial direction thereof, a heat pipe assembly including multiple U-shaped heat pipes, and an outer heat sink. Middle sections of the heat pipes form a smooth surface on which the LED module is attached. Straight sections of the heat pipes are coiled around the inner heat sink. The smooth surface is located at an end of the inner heat sink not to block the air passages of the inner heat sink. An annular vapor chamber is packaged a grid-shaped configuration of the heat pipes and attached to each heat pipe. The invention achieves fast heat conduction and dissipates the heat via the inner and outer heat sinks.

18 Claims, 20 Drawing Sheets

LED LIGHTING SYSTEM AND HIGH-POWER LED LAMP

BACKGROUND

1. Technical Field

The present disclosure relates to illumination, and, more particularly, to an LED lighting system and a high-power LED lamp based on network control.

2. Description of Related Art

Generally, high-power lamps are used in the place with large areas, such as Indoor and outdoor plaza, stadium, all kinds of commercial squares, industrial factories, mines or highways. With the popularity of LED (light-emitting diode) lighting, to seek a lighting plan with more energy saving and long life. At present, the high-power lamps used in the large occasions have already gradually replaced by high-power LED lamps.

The high-power LED lamps will achieve the ideal lighting effect when the power of the high-power LED lamps is in the range of 500 W to 1000 W. However, the heat-dissipating module in the prior art is generally at most used in the LED lamp with the power range of 100 W to 200 W. The heat-dissipating module of the prior art is difficult to meet the heat-dissipating requirement of the high-power LED lamp, except for the use of a fan or an additional cooling system.

As is well known, LEDs have strict requirements in an aspect of heat dissipation. Too high temperature will cause the LED luminous efficiency attenuation, if the heat generated by the LEDs can not be effectively dissipated, it will cause the life span reduction of the LEDs. Especially for some ultra-high-power LEDs, the heat-dissipation problem is particularly critical. If the heat of such high-power LEDs is not effectively dissipated, it will result in heat accumulation to thereby seriously affect the light-emitting efficiency and life span of such high-power LEDs, and even have security risks.

Therefore, it is very necessary to seek a more effective heat-dissipating scheme of high-power LED lamps.

In addition, with the rapid development of the current network technology, all kinds of electronic products can be controlled by network. LED lamps can also be controlled by network, so it is foreseeable that LED lamps are inevitably combined with network to realize the remote control.

Generally speaking, LED lamps have problems including the light intensity, color temperature, beam Angle, the emitting direction, the single point or more points controls and online fault diagnosis, etc. How to better control the problems of LED lamps is the key whether the LED lamps can supply more convenient service for users.

According to the above situation, the present invention supplies a solution for how to control the LED lamps by network.

SUMMARY OF THE INVENTION

The present invention provides an LED lighting system and a high-power LED lamp based on network control to realize a high-power lighting and have a suitable heat dissipation.

The LED lighting system has two type of structures; one of the structures are as follows: The LED lighting system includes a high-power LED lamp, the high-power LED lamp including: a control unit receiving a lighting instruction and outputting a control signal according the lighting instruction; an LED module comprising a base and a plurality of LED chips disposed on the base; and a driving unit connected to the control unit and outputting current with a corresponding intensity according to the control signal to drive the LED module.

The LED lighting system further includes an inner heat sink comprising an inner cylinder and an outer cylinder coiling around the inner cylinder, the inner cylinder and the outer cylinder being concentric with each other, a plurality of fins being disposed between the inner cylinder and the outer cylinder, air passages being defined between adjacent fins and generating a chimney effect due to the heat absorbed by the adjacent fins.

The LED lighting system further includes an outer heat sink having a hole defined therein and disposing a plurality of fins surrounding the hole and extending along an axial direction of the outer heat sink, air passages being defined between adjacent fins and generating the chimney effect due to the heat absorbed by the adjacent fins, the outer heat sink being coiled around the inner heat sink.

The LED lighting system further includes a first heat pipe assembly including a plurality of U-shaped heat pipes, middle sections of the heat pipes being put together to cooperatively form a smooth surface for securing the LED module thereon, straight sections of the heat pipes cooperatively forming a grid-shaped configuration that is coiled around the inner heat sink and is attached to an outer surface of the outer cylinder of the inner heat sink and a circumferential surface corresponding to the hole of the outer heat sink.

The LED lighting system further includes a second heat pipe assembly including a plurality of U-shaped heat pipes, middle sections of the second heat pipe assembly being located a rear side of the middle sections of the first heat pipe assembly, the middle sections of the second heat pipe assembly being substantially perpendicular to the middle sections of the first heat pipe assembly, straight sections of the second heat pipe assembly being coiled around the inner heat sink and being attached to the outer surface of the outer cylinder of the inner heat sink and the circumferential surface corresponding to the hole of the outer heat sink.

The LED lighting system further includes a supporting board being located between the middle sections of the first heat pipe assembly and the middle sections of the second heat pipe assembly, the supporting board having a first set of grooves defined in a first surface and a second set of grooves defined in a second surface, the first set of grooves receiving and locking the middle sections of the first heat pipe assembly therein; the second set of grooves receiving and locking the middle sections of the second heat pipe assembly therein, the supporting board defining a plurality of through holes so that the middle sections of the first and second heat pipe assembly contact with each other through the through holes, wherein a sum of a power of the first and second heat pipe assemblies is greater than or equal to a power of the LED module.

The heat generated by the LED module is transferred to the first and second heat pipe assemblies. The heat is conducted from the middle sections of the first and second heat pipe assemblies to the straight sections of the first and second heat pipe assemblies, and is transferred to the inner and outer heat sinks. The heat absorbed by the inner and outer heat sinks is dissipated by the fins of the inner and outer heat sinks.

An outer wall of the outer cylinder of the inner heat sink defines a plurality of first grooves extending along an axial direction of the inner heat sink. The straight sections of the heat pipes are secured in the first grooves. Each of the first grooves has an arc-shaped cross section. Each of the heat pipes has an arc-shaped face corresponding to the first groove.

Similarly, a circumferential surface corresponding to the hole of the outer heat sink defines a plurality of second grooves along the axial direction of the outer heat sink. The straight sections of the heat pipes are secured in the second grooves. Each of the second grooves has an arc-shaped cross section. Each of the heat pipes has an arc-shaped face corresponding to the second groove.

A plurality of fins are disposed at a position close to the first grooves of the inner heat sink. A plurality of fins are disposed at a position close to the second grooves of the outer heat sink.

Each of the U-shaped heat pipes is bent from a single heat pipe or is pieced together from two L-shaped heat pipes.

A plurality of extending holes are defined in the inner cylinder of the inner heat sink and allow the air flowing therethrough.

The LED lighting system further includes a supporting board disposed at a rear side of the heat pipe assembly, wherein the supporting board has a set of grooves defined therein, and the middle sections of the heat pipe assembly are secured in the grooves.

The heat pipes of the first and second heat pipe assemblies are sintered heat pipes each having grooves defined in an inner surface thereof. A number of the grooves defined in each of the sintered heat pipes is greater than 120. A width between adjacent grooves is less than 0.1. Each of the sintered heat pipes has a thermal resistance less than 0.05□/watt.

The other type of the LED lighting system as follows: The LED lighting system includes a high-power LED lamp, the high-power LED lamp including: a control unit receiving a lighting instruction and outputting a control signal according the lighting instruction; an LED module comprising a base and a plurality of LEDs chips disposed on the base; and a driving unit connected to the control unit and outputting current with a corresponding intensity according to the control signal to drive the LED module.

The LED lighting system further includes an inner heat sink comprising an inner cylinder and an outer cylinder coiling around the inner cylinder, the inner cylinder and the outer cylinder being concentric with each other, a plurality of fins being disposed between the inner cylinder and the outer cylinder, air passages being defined between adjacent fins and generating the chimney effect due to the heat absorbed by the adjacent fins.

The LED lighting system further includes a heat pipe assembly comprising a plurality of U-shaped heat pipes, middle sections of the heat pipes being put together to cooperatively form a smooth surface for securing the LED module thereon, straight sections of the heat pipes cooperatively forming a grid-shaped configuration that is coiled around the inner heat sink and is attached to an outer surface of the inner heat sink, the smooth surface being located at an end of the inner heat sink not to block the air passages of the inner heat sink to the greatest extent.

The LED lighting system further includes an annular vapor chamber packaged the grid-shaped configuration of the heat pipes and attached to an outer side of each heat pipe.

The LED lighting system further includes an outer heat sink having a hole defined therein and disposing a plurality of fins surrounding the hole and extending along an axial direction of the outer heat sink, air passages being defined between adjacent fins and generating the chimney effect due to the heat absorbed by the adjacent fins, wherein the sum of the power of the heat pipe assembly and the vapor chamber is greater than or equal to the power of the LED module.

The heat generated by the LED module is transferred to the heat pipe assembly. The heat is conducted from the smooth surface to the straight sections of the heat pipe assembly, and then the heat on the heat pipe assembly is transferred to the inner heat sink and the vapor chamber. The heat on the vapor chamber is transferred to the outer heat sink.

An outer wall of the outer cylinder of the inner heat sink defines a plurality of grooves extending along an axial direction of the inner heat sink. The straight sections of the heat pipes are secured in the grooves. Each of the grooves has an arc-shaped cross section. Each of the heat pipes has an arc-shaped face corresponding to the groove. The heat pipes are attached to the vapor chamber.

In addition, in order to improve the heat dissipation, an additional vapor chamber is disposed between the LED module and the smooth surface of the heat pipe assembly, and the LED module is attached to the additional vapor chamber.

A supporting frame supporting for the heat pipe assembly is disposed between the smooth surface of the heat pipe assembly and the inner heat sink. A group of grooves is defined in a bottom surface of the supporting frame to receive the middle sections of the heat pipe assembly therein. A top surface of the supporting frame is tightly contact with the inner heat sink.

The LED lighting system further includes remote control equipment used to output an instruction signal, a communications network receiving the instruction signal from the remote control equipment and outputting a lighting instruction according to the instruction signal, and at least one high-power LED lamp described above.

The LED module includes three primary color LEDs including red LED, green LED, and blue LED. The high-power LED lamp further includes three color temperature drive circuits respectively connected to the red LED, the green LED and the blue LED. The color temperature drive circuits output current with a corresponding intensity according to the control signal of the control unit to drive the red LED, the green LED and the blue LED for adjusting the color temperature of the LED module.

The high-power LED lamp further includes a direction-adjusting device. The direction-adjusting device includes a direction-adjusting motor and a transmission module. The direction-adjusting motor is connected to the control unit and adjusts the direction of the high-power LED lamp according a control signal of the control unit via the transmission module.

The high-power LED lamp further includes a lens transmitting light of the LED module and an angle-adjusting device adjusting a distance between the LED module and the lens. The angle-adjusting device includes a motor and a transmission module. The motor is connected to the control unit and adjusts a distance between the lens and the LED module according to a control signal of the control unit via the transmission module.

The remote control equipment could be a mobile phone, a handheld device or computers.

The heat generated by the LED module is transferred to the first and second heat pipe assemblies. The heat is absorbed by the middle sections of the first and second heat pipe assemblies and then is transferred to the straight sections. The heat on the first and second heat pipe assemblies is transferred to the inner and outer heat sinks and is dissipated by the fins of the inner and outer heat sinks.

The LED lighting system controls the light intensity, the color temperature, light emitting angle, and light emitting direction of one or more than one LED lamps via the remote control equipment. The LED lighting system realizes a unified management. The invention is combined with a network platform to facilitate the development of LED technology. The LED management is more intuitive and user-friendly and gives users a better experience. In addition, the invention realizes light intensity and color temperature automatic adjustment, and is beneficial to energy saving. The invention adopts the heat pipe as a superconductor, the heat pipe transfers the heat generated by the LED module to the inner and outer heat sinks, and then the heat on the inner and outer heat sinks is dissipated by the fins. The invention achieves fast heat conduction and dissipates the heat via the inner and outer heat sinks. The invention is used in LED lighting with power of 250 w~1000 W and can ensure stability of dissipating heat and long service life.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
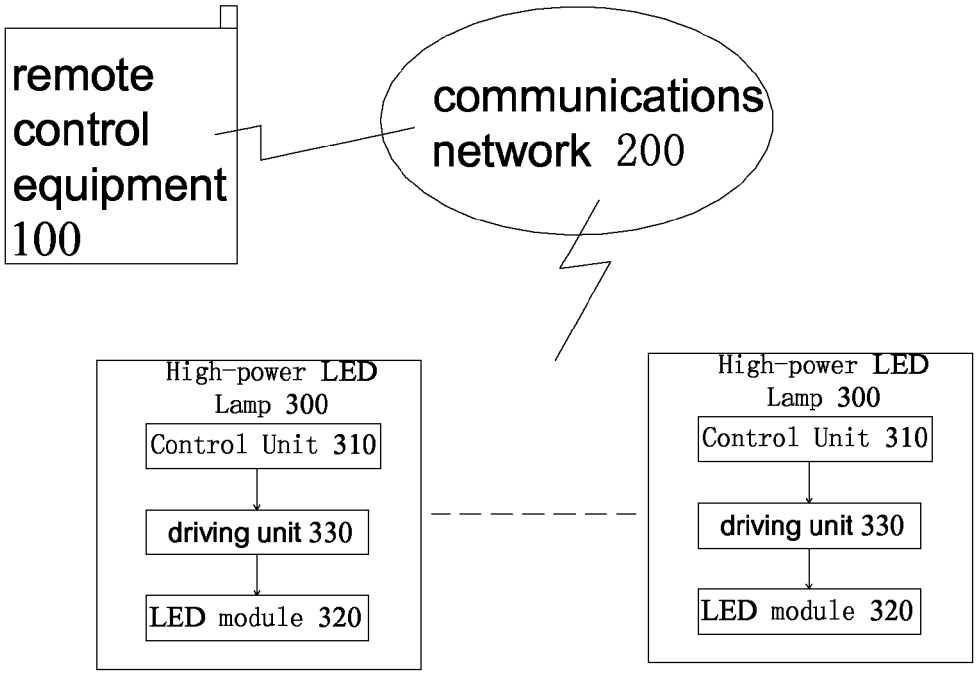
FIG. 1 is a schematic diagram of an LED lighting system in accordance with an embodiment of the disclosure, wherein the LED lighting system comprises at least one high-power LED lamp.

Referring to FIG. 1, an LED (light-emitting diode) lighting system is illustrated. The LED lighting system supplies a high-power LED lighting and is controlled by network. The LED lighting system includes a remote control equipment 100, a communications network 200, and at least a high-power LED lamp 300.

The remote control equipment 100 is used to output an instruction signal and is taken as a system control terminal. The remote control equipment 100 could be a mobile phone, a handheld device, for example, a PDA, or other type of computers such as a PC, a netbook, a tablet, etc. . . . The remote control equipment 100 could adopt a wire transmission, a wireless transmission or both. Users can download a special software of the present invention and input a specific control code or other specific registered modes into the special software, for matching the LED lighting system. Users input the control signal into the remote control equipment 100 as a terminal to control the lamp.

The communications network 200 receives the instruction signal from the remote control equipment 100, and outputs a lighting instruction according to the instruction signal. The communication network 200 could adopt any prior art in networks such as GSM, GPRS, 3G, or Internet network.

The at least a high-power LED lamp 300 includes a control unit 310, an LED module 320, and a driving unit 330.

The control unit 310 receives the lighting instruction from the communications network 200 and outputs a control signal according the lighting instruction. The control unit 310 may receive the lighting instruction from the communications network 200 via a wireless or wire transmission.

The LED module 320 includes a base and a plurality of LED chips disposed on the base.

The driving unit 330 is electrically connected to the control unit 310 and outputs current with a corresponding intensity according to the control signal to drive the LED module 320.

In this embodiment, users may input various of commands via the remote control equipment 100. The commands are accepted by the control unit 310 via the communications network 200. The control unit 310 sends out a corresponding command according to the commands to control the high-power LED lamps 300.

In this embodiment, the remote control equipment 100 may control one or more than one high-power LED lamps 300. For more than one high-power LED lamps 300, the remote control equipment 100 may control them individually or control simultaneously a group of the high-power LED lamps 300. If there is only one high-power LED lamp 300 to be controlled, the remote control equipment 100 separately controls the high-power LED lamp 300. If there are more than one high-power LED lamps 300 to be controlled, the remote control equipment 100 chooses the set of the high-power LED lamps 300 which needs to be controlled and chooses a corresponding command to control the set of the high-power LED lamps 300, thereby realizing a unified control.

Control functions that the present invention can realize including:

1. Light Intensity Adjustment

Figure 2:
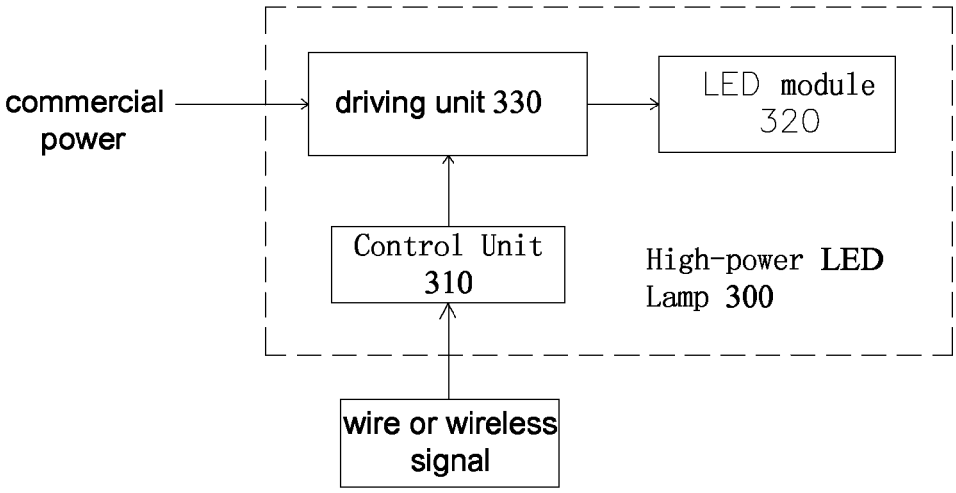
FIG. 2 is a circuit block diagram of the high-power LED lamp in accordance with a first embodiment of the disclosure.
Figure 3:
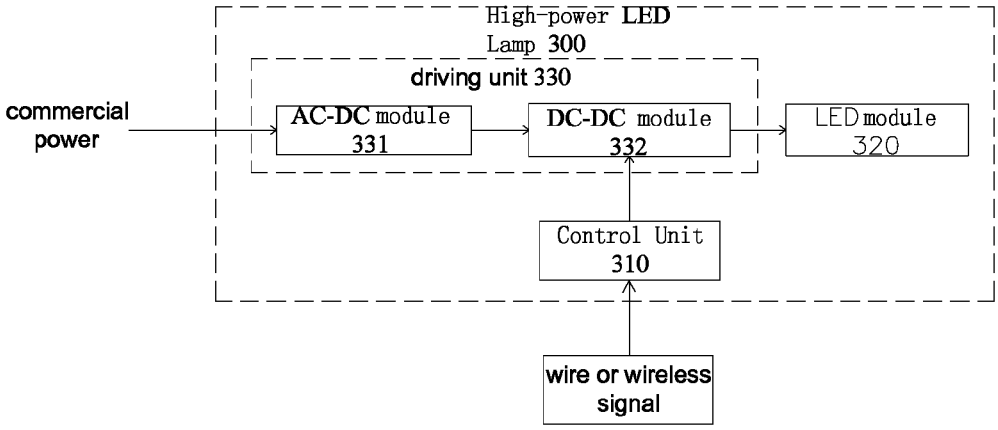
FIG. 3 is a circuit block diagram of the high-power LED lamp in accordance with a second embodiment of the disclosure.

The remote control equipment 100 controls a light intensity of the high-power LED lamp 300, for adjusting the light intensity of the high-power LED lamp 300. Referring to FIG. 2, the driving unit 330 of the high-power LED lamp 300 directly controls the driving current of the LED module 320 and is taken as an input of the LED module 320. The driving unit 330 is electrically connected to the control unit 310 and is controlled by the control unit 310. Users input a corresponding command such as brightening or darkening instructions via the remote control equipment 100, wherein the brightening or darkening instructions are intuitively presented on interfaces of the remote control equipment 100. The corresponding command is transmitted to the control unit 310 of the high-power LED lamp 300 via the communications network 200. The control unit 310 sends out a signal to the driving unit 330 according to the corresponding command. The driving unit 330 provides current with a special intensity for the LED module 320, thereby controlling the LED module 320 to emit light with a special light intensity. Referring to FIG. 3, the driving unit 330 includes an AC-DC module 331 and a DC-DC module 332. The AC-DC module 331 is connected to a commercial power. The DC-DC module 332 is connected to the AC-DC module 331. The DC-DC module 332 is connected to the control unit 310 and is controlled by the control unit 310. The commercial power is converted into a direct current via the AC-DC module 331 for supplying for the DC-DC module 332. The DC-DC module 332 is controlled by the control unit 310 and converts the direct current into a suitable output current, thereby supplying electric energy for the LED module 320.

Figure 4:
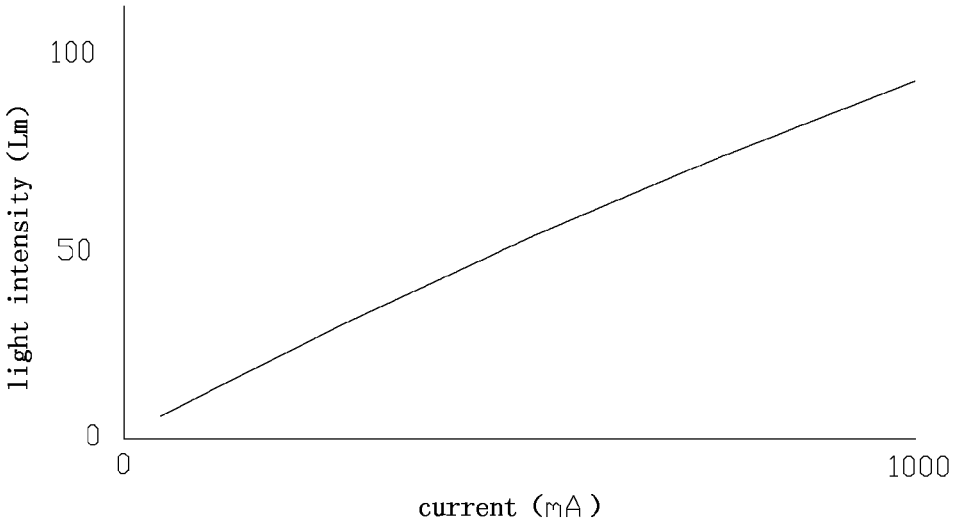
FIG. 4 shows a linear relationship between a light intensity and a working current of an LED module of the high-power LED lamp.
Figure 5:
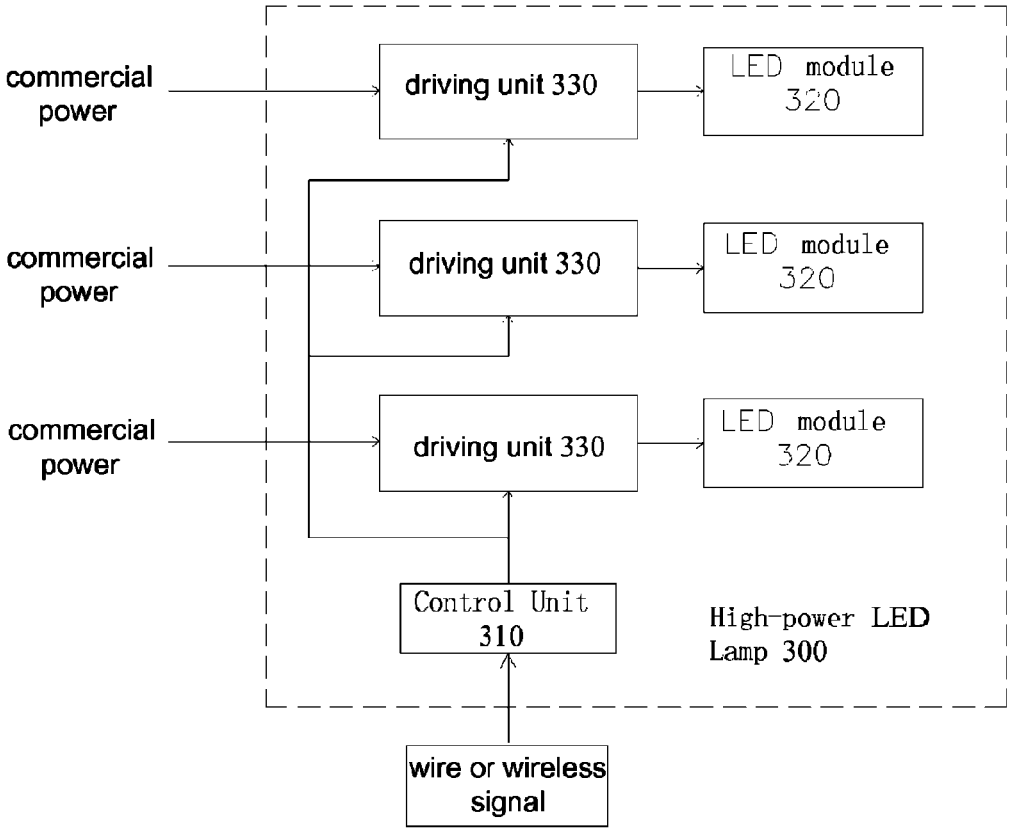
FIG. 5 is a circuit block diagram of the high-power LED lamp in accordance with a third embodiment of the disclosure.

In a word, the present invention supplies two embodiments about the driving modes which the driving unit 330 drives the LED module 320. FIG. 4 shows a linear relation between the light intensity and the working current of the LED module 320. The DC-DC module 332 adjusts the input current of the LED module 320 in a linear stepless manner, thereby making the light intensity of the LED module 320 continuous increase or decrease. The DC-DC module 332 adjusts the input current of the LED module 320 in a nonlinear multilevel light-adjusting way, for example, 256 levels. Referring to FIG. 5, a plurality of driving units 330 drive a plurality of LED modules 320, respectively. For a 1000 W-power LED lamp, the LED lamp includes four driving units 330 and four LED modules 320 respectively connected to the driving units 330. Each of the LED modules 320 may have 300 w. The DC-DC modules 332 of the four driving units 330 are connected with the control unit 310 and are separately controlled by the control unit 310, thereby realizing four-stage light modulation. When needing a minimum light intensity, the control unit 310 controls only one of the driving units 330 and a corresponding one of the LED modules 320 to work, at the same time, the high-power LED lamp 300 consumes 250 W of power including the power loss in the practical use. When needing a maximum light intensity, the control unit 310 controls all of the driving units 330 and all of the LED modules 320 to work, at the same time, the high-power LED lamp 300 consumes 1000 W of power including the power loss in the practical use.

2. Color Temperature Adjustment

Figure 6:
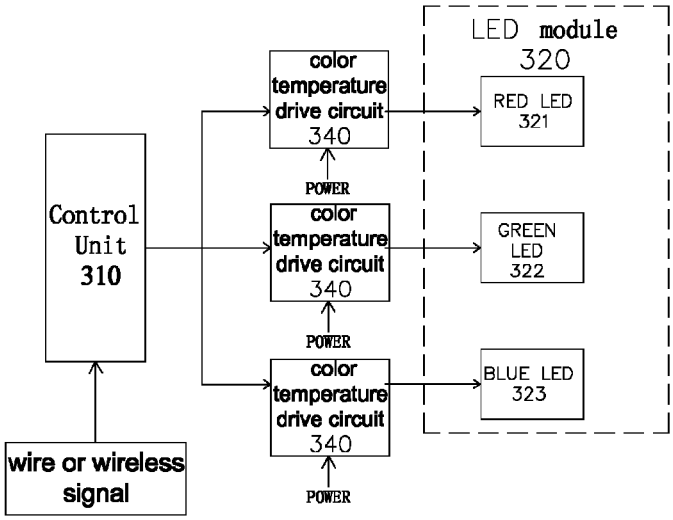
FIG. 6 is a circuit block diagram of the high-power LED lamp in accordance with a fourth embodiment of the disclosure.

The remote control equipment 100 controls the color temperature of the high-power LED lamp 300. The LED module 320 includes three primary color LEDs: red LED 321, green LED 322, and blue LED 323. The light of the red LED 321, the green LED 322 and the blue LED 323 is mixed to obtain a final color temperature of the LED module 320. The color temperature of each of the red LED 321, the green LED 322 and the blue LED 323 is relative to its brightness. Therefore, in the present invention, the LED module 320 presents different color temperatures by controlling the brightness of three primary colors LEDs. FIG. 6 shows a preferred embodiment of the present invention. The red LED 321, the green LED 322 and the blue LED 323 have their power inputs connected to color temperature drive circuits 340, respectively. The output current of the color temperature drive circuits 340 is controlled by the control unit 310. The output current of the color temperature drive circuits 340 is different, whereby the red LED 321, the green LED 322 and the blue LED 323 obtain different light beams with different brightness. The different light beams are mixed to obtain light beams with different color temperatures.

In this embodiment, a wavelength of the red LED 321 could be 615~620 nm; a wavelength of the green LED 322 could be 530~540 nm; a wavelength of the blue LED 323 could be 460~470 nm. Users input a corresponding command via the remote control equipment 100, for example, lowering the color temperature, and the control unit 310 receives the corresponding command via the communications network 200 and sends out a corresponding instruction to increase the brightness of the red LED 321 or decrease the brightness of the blue LED 323, thereby raising or lowering the color temperature.

3. Light Emitting Angle Adjustment

Figure 7:
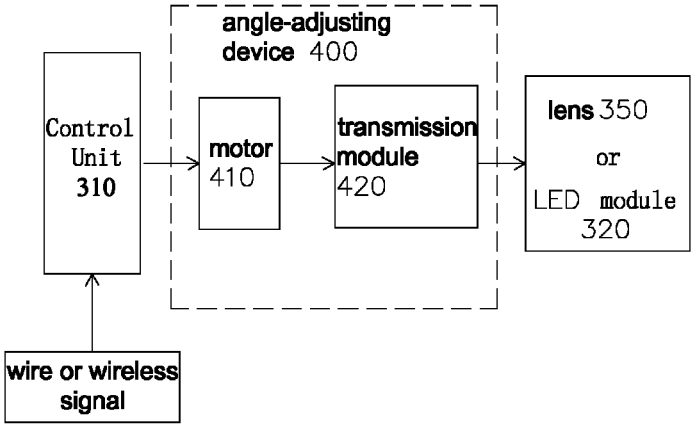
FIG. 7 shows an angle-adjusting device used in the high-power LED lamp.
Figure 8:
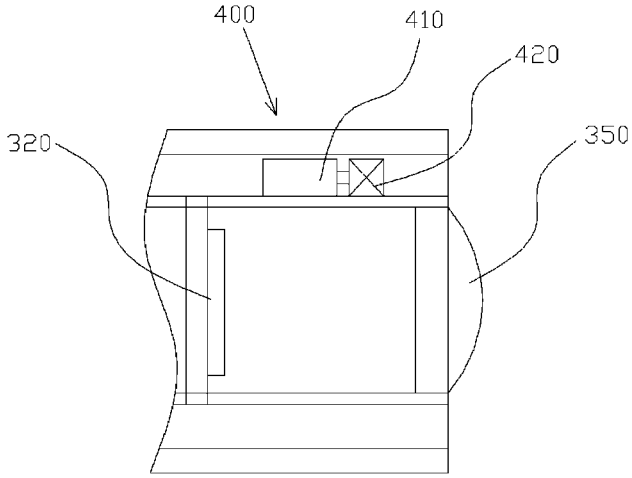
FIG. 8 shows a structure of the high-power LED lamp.
Figure 9:
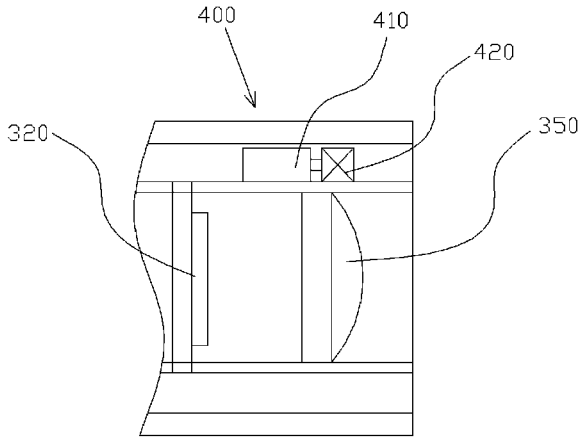
FIG. 9 shows another structure of the high-power LED lamp.

The light emitting angle in the present invention is a light emitting angle emitting out of the high-power LED lamp 300. The light coverage area reflects the light emitting angle of the high-power LED lamp 300. The light emitting angle of the high-power LED lamp 300 is controlled by an angle-adjusting device 400. Referring to FIGS. 7-9, the high-power LED lamp 300 includes a lens 350 transmitting light of the LED module 320 and the angle-adjusting device 400 adjusting a distance between the LED module 320 and the lens 350. A typical angle-adjusting device 400 includes a motor 410 and a transmission module 420. The transmission module 420 controls the lens 350 or the LED module 320 to work, thereby adjusting the distance between the lens 350 and the LED module 320. The light emitting from the LED module 320 is refracted by the lens 350 and then projects into an ambient environment. The distance between the lens 350 and the LED module 320 is relative to the light emitting angle of the light emitting out of the lens 350. Therefore, that adjusting the distance between the lens 350 and the LED module 320 can achieve the ultimate light-emitting angle adjustment. Users input a corresponding command via the remote control equipment 100, for example, increasing the light emitting angle, and the control unit 310 receives a lighting instruction from the communications network 200 and controls the motor 410 of the angle-adjusting device 400 to positively or reversely rotate. Referring also to FIG. 9, the transmission module 420 controls the lens 350 to close to the LED module 320 so as to increase the light emitting angle of the light emitting out of the lens 350, thereby increasing the light emitting angle of the high-power LED lamp 300. Conversely, the transmission module 420 controls the lens 350 to be far away from the LED module 320 so as to decrease the light emitting angle of the light emitting out of the lens 350, thereby decreasing the light emitting angle of the high-power LED lamp 300. The angle-adjusting device 400 realizes a stepless adjustment of the light emitting angle of the high-power LED lamp 300, for facilitating a free control.

4. Light Emitting Direction Adjustment

Figure 10:
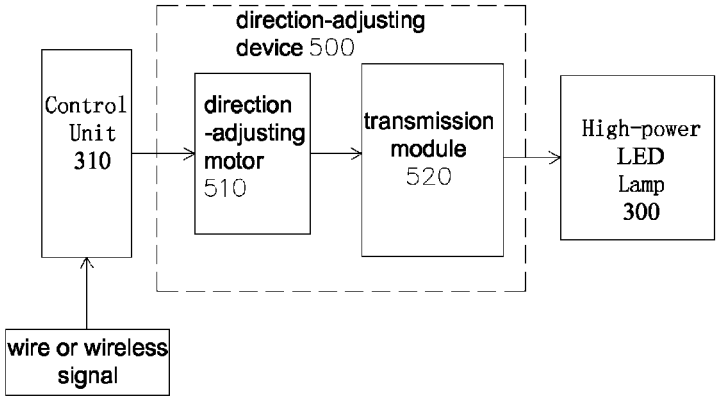
FIG. 10 shows a direction-adjusting device used in the high-power LED lamp.
Figure 11:
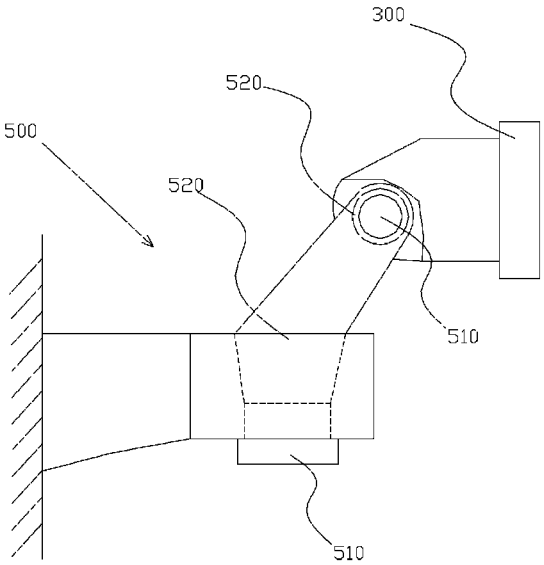
FIG. 11 shows a structure of the high-power LED lamp with the direction-adjusting device.

Referring to FIGS. 10-11, in the present invention, the light emitting direction of the high-power LED lamp 300 is controlled by a direction-adjusting device 500. A typical direction-adjusting device 500 includes a direction-adjusting motor 510 supplying power and a transmission module 520. The main body of the high-power LED lamp 300 is secured by the transmission module 520. For adjusting the light emitting direction in a wide angle, the transmission module 520 at least includes two dimensional steering structures, and the direction-adjusting motor 510 at least includes two dimensional drive power. Users input a corresponding command via the remote control equipment 100, for example, controlling the high-power LED lamp 300 to rotate along a specified direction, and the control unit 310 receives a lighting instruction from the communications network 200 and controls the direction-adjusting motor 510 of the direction-adjusting device 500 to move along the specified direction. The direction-adjusting motor 510 drives the transmission module 520, and the transmission module 520 drives the main body of the high-power LED lamp 300 to rotate along the specified direction, thereby realizing the light emitting direction adjustment. The direction-adjusting device 500 realizes a stepless adjustment of the light emitting direction of the high-power LED lamp 300, facilitating a free control of the direction of illumination.

5. Fault Diagnosis

Figure 12:
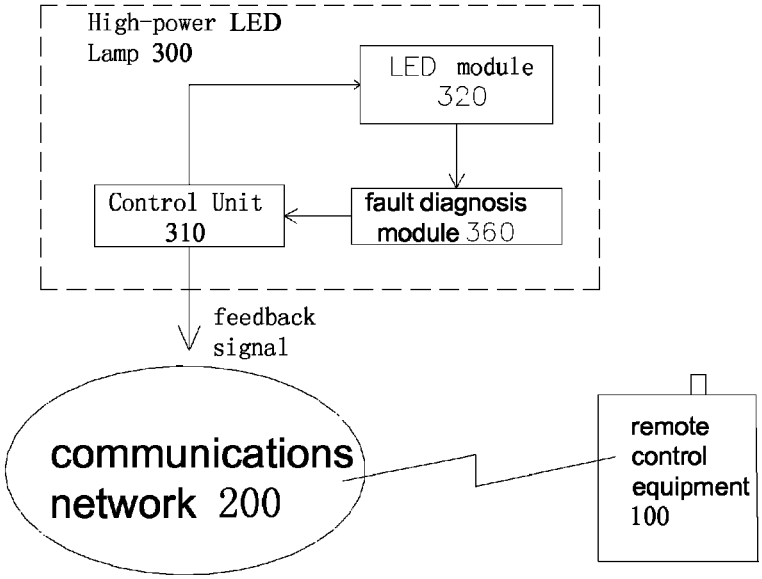
FIG. 12 shows a fault diagnosis module used in the high-power LED lamp.

The present invention provides two-way linkage from a user terminal to a lighting terminal. The user terminal is the remote control equipment 100, and the lighting terminal is the high-power LED lamp 300. The LED lighting system further adds a function which provides feedback information to the user from the high-power LED lamp 300. Referring to FIG. 12, the LED lighting system adds a fault diagnosis module 360 in a circuit structure of the high-power LED lamp 300. The fault diagnosis module 360 may be electrically connected to the power supply end and each of electronic elements of the circuit structure of the high-power LED lamp 300. The fault diagnosis module 360 is connected to the control unit 310. If the power supply is not normally working or part of the electronic elements have faults, the fault diagnosis module 360 can detect these faults in time and sends the results to the control unit 310, and then the communications network 200 receives signals from the control unit 310 and sends SMS, identifiable information or E-mail to users, thereby reminding users to deal with these faults.

6. Automatic Light Intensity Adjustment

Figure 13:
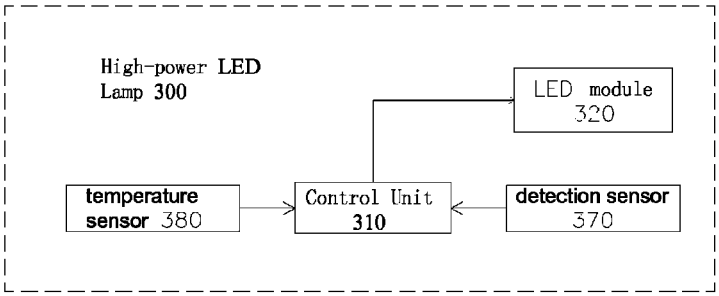
FIG. 13 shows a detection sensor used in the high-power LED lamp.

Referring to FIG. 13, the LED lighting system further includes a detection sensor 370 connected to the control unit 310. The detection sensor 370 may be an infrared sensor or an image sensor. The detection sensor 370 scans the Illumination area of the high-power LED lamp 300. When there are many persons (for example, more than three) in the illumination area, the detection sensor 370 sends a signal to the control unit 310, and the control unit 310 controls the driving unit 330 to increase its output current, thereby improving the light intensity of the LED module 320 so that the brightness of the high-power LED lamp 300 is increased. When there are a little persons or no person in the illumination area, the detection sensor 370 sends a signal to the control unit 310, and the control unit 310 controls the driving unit 330 to decrease its output current, thereby reducing the light intensity of the LED module 320 so that the brightness of the high-power LED lamp 300 is decreased or is in a state of dormancy. Therefore, it is realizable to automatically adjust the brightness of the high-power LED lamp 300, and it is realizable to give the results back to the remote control equipment 100.

7. Color Temperature Automatic Adjustment

Referring also to FIG. 13, the LED lighting system further includes a temperature sensor 380 connected to the control unit 310 for monitoring an environmental temperature. When the temperature changes in the environment, for example, the temperature decreases, the temperature sensor 380 sends a signal to the control unit 310, and then the control unit 310 controls color temperature drive circuits 340 to adjust the input current of the red LED 321, the green LED 322, and the blue LED 323, for example, increasing the input current of the red LED 321 to thereby improve its brightness, finally, the LED module 320 reduces its color temperature, making the person feel comfortable.

It can be seen that the control for the illumination may realize through the network. The LED lighting system may adopt other control methods except for the network. The control unit 310 may be a switch or a knob secured on a wall and adopts a manual control.

The present invention has another object to provide a high-power lighting with a good heat generation.

Figure 14:
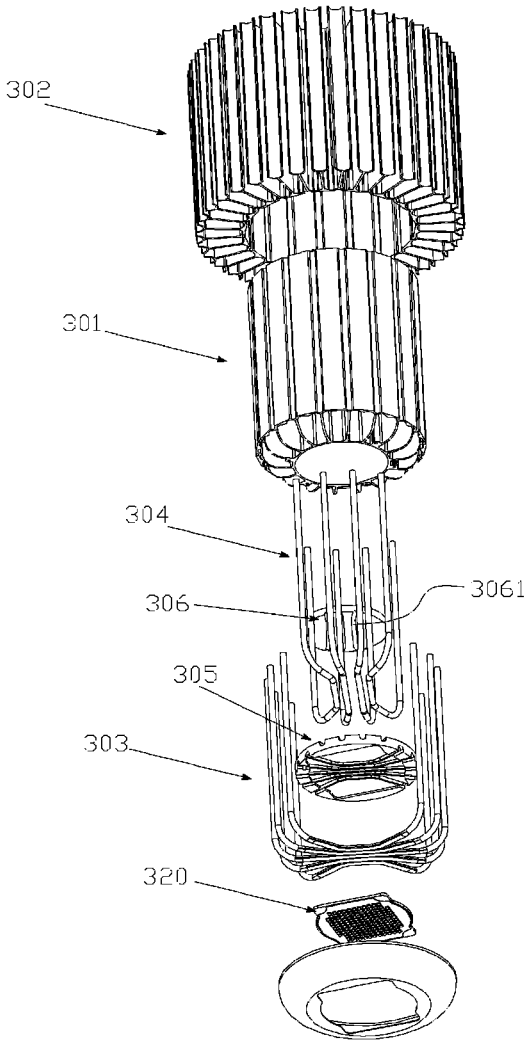
FIG. 14 shows an exploded structure of the high-power LED lamp according to a first embodiment of the present invention.

Referring to FIG. 14, a high-power LED lamp 300 is illustrated according to an embodiment of the present invention. The high-power LED lamp 300 includes an LED module 320, an inner heat sink 301, an outer heat sink 302, a first heat pipe assembly 303, a second heat pipe assembly 304, and a supporting board 305.

The LED module 320 is a high-power element. The LED module 320 includes a base and a plurality of LEDs packaging on the base. The heat generated by the LEDs must be dissipated in time. The base may be taken as a fixed structure and may be taken as a circuit structure. The base transfers the heat generated by the LEDs to the first heat pipe assembly 303 and the second heat pipe assembly 304. The first heat pipe assembly 303 and the second heat pipe assembly 304 dissipate the heat conducted by the base.

Figure 15:
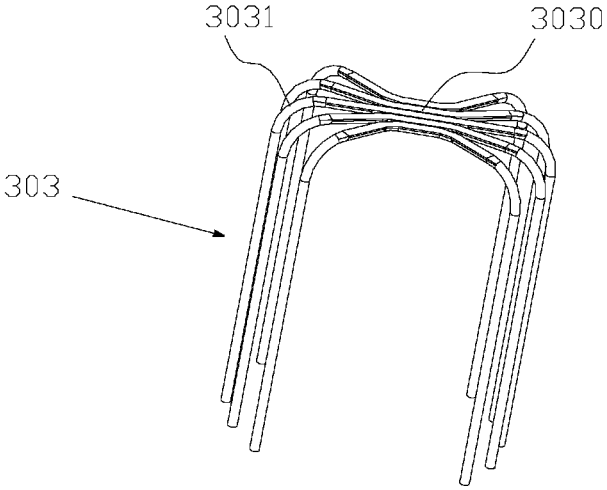
FIG. 15 shows a view of a first heat pipe assembly of the high-power LED lamp of FIG. 14.

Referring to FIG. 15, the first heat pipe assembly 303 includes a plurality of U-shaped heat pipes 3031. Each of the U-shaped heat pipes 3031 includes three sections, namely two straight sections and a middle section between the straight sections. Each of the U-shaped heat pipes 3031 may be bent from a single heat pipe and may be pieced together from two L-shaped heat pipes. The middle sections of the U-shaped heat pipes 3031 are put or soldered together to cooperatively form a smooth surface 3030 for securing the LED module 320 thereon. The straight sections of the U-shaped heat pipes 3031 are located a side of the smooth surface 3030 and are distributed along a partial circumference of the smooth surface 3030 to form a grid-shaped configuration.

Figure 16:
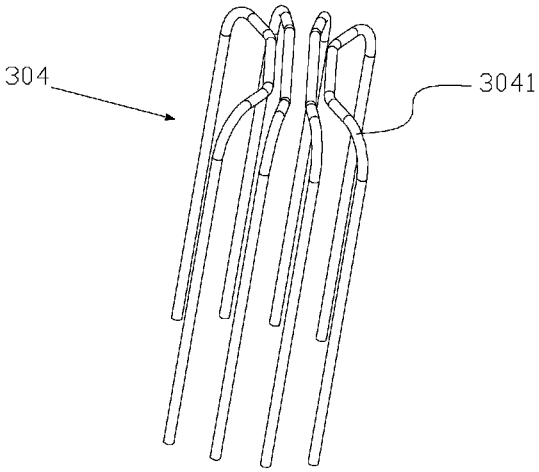
FIG. 16 shows a view of a second heat pipe assembly of the high-power LED lamp of FIG. 14.

Referring to FIG. 16, the second heat pipe assembly 304 includes a plurality of U-shaped heat pipes 3041. Each of the U-shaped heat pipes 3041 includes three sections, namely two straight sections and a middle section between the straight sections. Each of the U-shaped heat pipes 3041 may be bent from a single heat pipe and may be pieced together from two L-shaped heat pipes. The middle sections of the second heat pipe assembly 304 are located a rear side of the middle sections of the first heat pipe assembly 303. The middle sections of the second heat pipe assembly 304 are substantially perpendicular to the middle sections of the first heat pipe assembly 303. The straight sections of the second heat pipe assembly 304 have a same extending direction with the straight sections of the first heat pipe assembly 303. Due to the vertical cross of the first and second heat pipe assemblies 303, 304, a grid-shaped configuration formed by the straight sections of the second heat pipe assembly 304 is complementary to the grid-shaped configuration formed by the straight sections of the first heat pipe assembly 303 so that the straight sections of the first and second heat pipe assemblies 303, 304 cooperatively form an annular and grid-shaped configuration.

Figure 17:
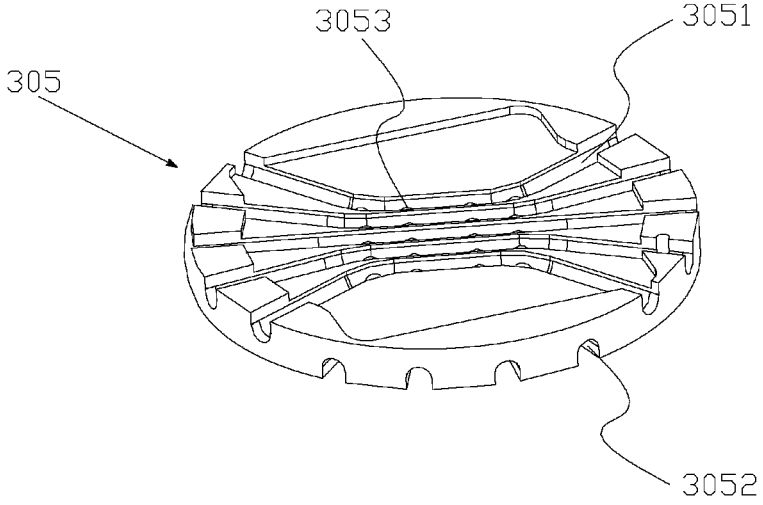
FIG. 17 shows a view of a supporting board of the high-power LED lamp of FIG. 14.
Figure 18:
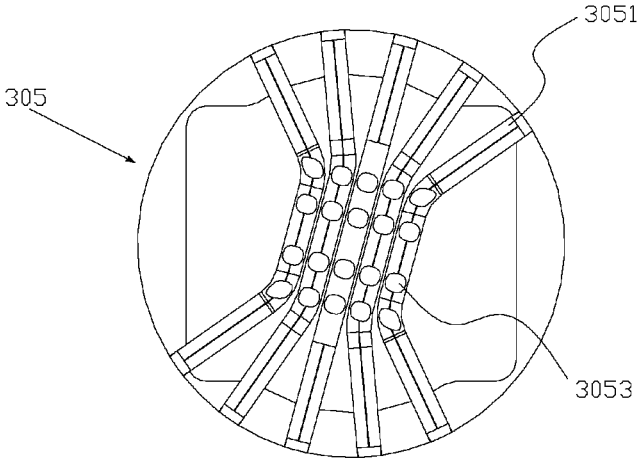
FIG. 18 shows a front view of the supporting board of FIG. 17.

The supporting board 305 is located between the middle sections of the first heat pipe assembly 303 and the middle sections of the second heat pipe assembly 304 so as to strengthen the connection between the first and second heat pipe assemblies 303, 304. Referring to FIG. 17, the supporting board 305 has a first set of grooves 3051 defined in a first surface and a second set of grooves 3052 defined in a second surface. The first set of grooves 3051 receives and locks the middle sections of the first heat pipe assembly 303 therein; the second set of grooves 3052 receives and locks the middle sections of the second heat pipe assembly 304 therein. Preferably, the supporting board 305 is made of metal with good heat conduction. In order to improve the heat transfer efficiency between the first and second heat pipe assemblies 303, 304, the supporting board 305 defines a plurality of through holes 3053, viewed from FIG. 18. Each of the through holes 3053 extends through one of the first set of grooves 3051 and a corresponding one of the second set of grooves 3052. When the middle sections of the first heat pipe assembly 303 are locked in the first set of grooves 3051 and the middle sections of the second heat pipe assembly 304 are locked in the second set of grooves 3052, the middle sections of the first and second heat pipe assembly 303, 304 contact with each other through the through holes 3053, thereby reducing a thermal resistance therebetween.

In assembly of the high-power LED lamp 300, the second heat pipe assembly 304 includes multiple heat pipes. In order to facilitate to secure the second heat pipe assembly 304, the LED lighting system further includes an additional supporting board 306 disposed inside of the second heat pipe assembly 304. In this embodiment, the additional supporting board 306 is disposed at a rear side of the middle sections of the second heat pipe assembly 304. The additional supporting board 306 has an additional set of grooves 3061 defined in a surface facing to the middle sections of the second heat pipe assembly 304. The middle sections of the second heat pipe assembly 304 are locked in the additional set of grooves 3061.

Figure 19:
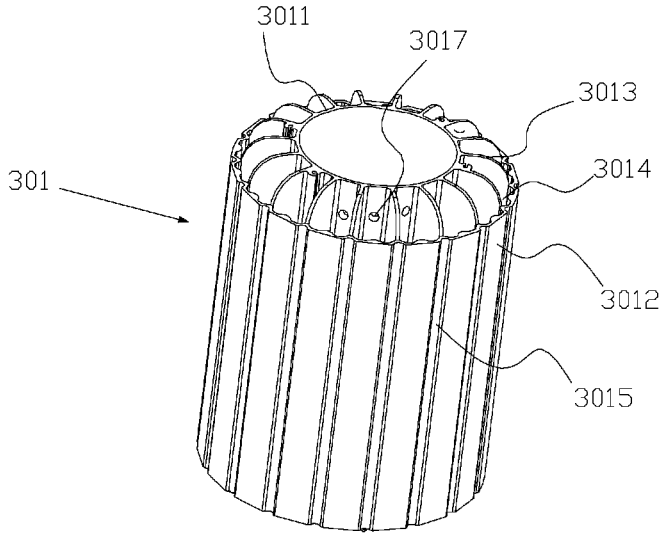
FIG. 19 shows a view of an inner heat sink of the high-power LED lamp of FIG. 14.

Referring to FIG. 19, the inner heat sink 301 includes an inner cylinder 3011 and an outer cylinder 3012 coiling around the inner cylinder 3011. The inner cylinder 3011 and the outer cylinder 3012 are concentric with each other. A plurality of fins 3013 are disposed between the inner cylinder 3011 and the outer cylinder 3012. Air passages 3014 are defined between adjacent fins 3013 and generate the chimney effect due to the heat absorbed by the adjacent fins 3013. In assembly of the high-power LED lamp 300, various mating parts of the high-power LED lamp 300 such as the driving unit 330, the control unit 310 may optionally be disposed in the inner cylinder 3011 so that the mating parts are hid in the inner cylinder 3011. Wires extend from an interior of the inner cylinder is 3011 and are connected to pins of the LED module 320 or a metal heat-conduction component. In a preferred embodiment, a plurality of extending holes 3017 are defined in the inner cylinder 3011 of the inner heat sink 301 and allow the air which flows into the interior of the inner cylinder 3011 to pass therethrough into the air passages 3014 and near the fins 3013, for improving the heat dissipation of the high-power LED lamp.

Figure 20:
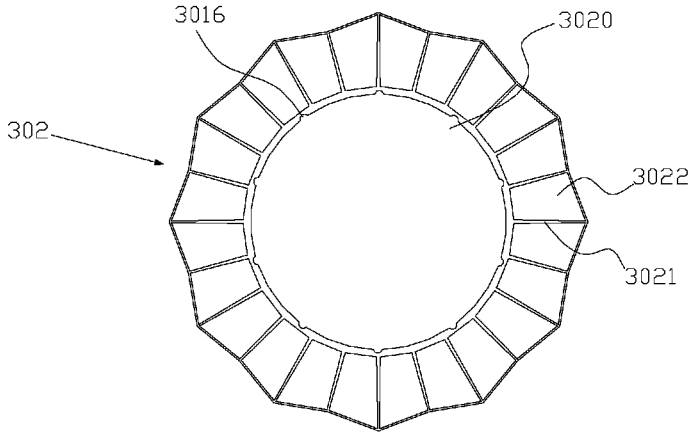
FIG. 20 shows a view of an outer heat sink of the high-power LED lamp of FIG. 14.

The outer heat sink 302 has a hole 3020 defined therein. The outer heat sink 302 disposes a heat-dissipation structure in a circumference thereof. The heat-dissipation structure extends along an axial direction of the outer heat sink 302. The heat-dissipation structure has a large area contacting with an ambient air, improving the cooling effect. Referring to FIG. 20, in a preferred embodiment, a plurality of air passages 3022 are defined in a circumference of the outer heat sink 302, extend along an axial direction of the outer heat sink 302, and generate the chimney effect due to the heat conducted by the first and second heat pipe assemblies 303, 304, thereby raising the speed of air flow and realizing a rapid heat conduction. In the design and manufacturing, the outer heat sink 302 may include a first cylinder and a second cylinder concentric with the first cylinder. The first cylinder has a diameter larger than the second cylinder. The first cylinder is coiled around the second cylinder. A plurality of fins 3021 radially extend from a circumference of the first cylinder to a circumference of the second cylinder. The second cylinder defines a through hole therein. The inner heat sink 301 and the annular and girds-shaped configuration formed by the first heat pipe assembly 303 and the second heat pipe assembly 304 are received in the through hole of the second cylinder. The air passages 3022 are defined between adjacent fins 3021.

Figure 21:
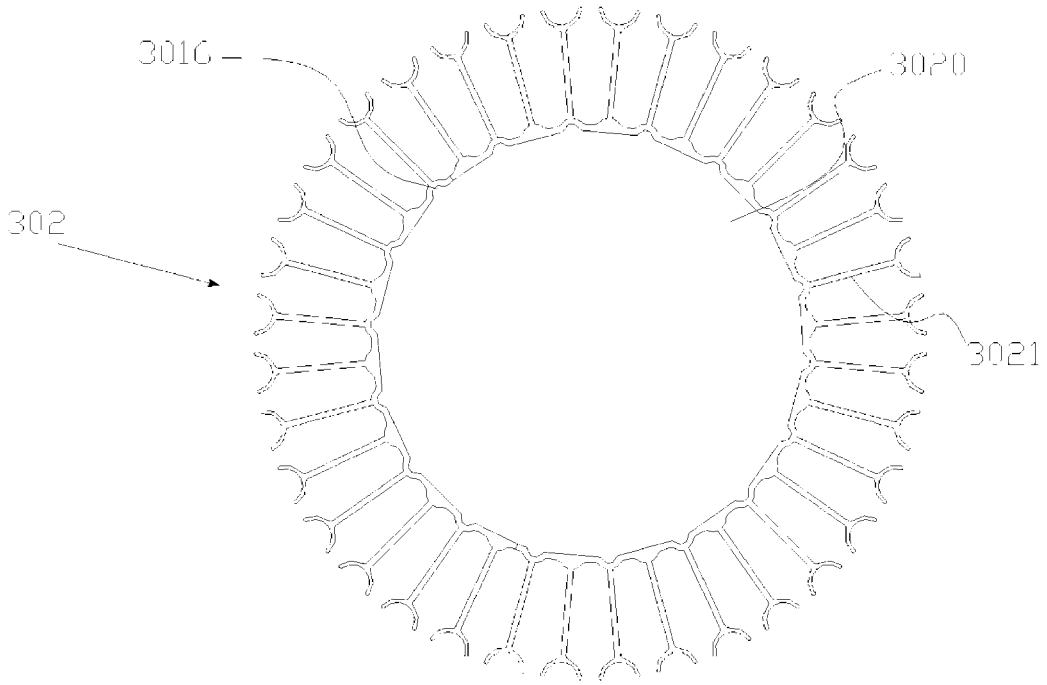
FIG. 21 shows a view of the outer heat sink with another structure of the high-power LED lamp of FIG. 14.

Referring to FIG. 21, as another preferred embodiment, the outer heat sink 302 disposes a plurality of fins 3021 on the circumference thereof. Each of the fins 3021 may be Y-shaped or T-shaped. The fins 3021 may be connected with each other to obtain a large heat-dissipation area, and still have the chimney effect.

Figure 23:
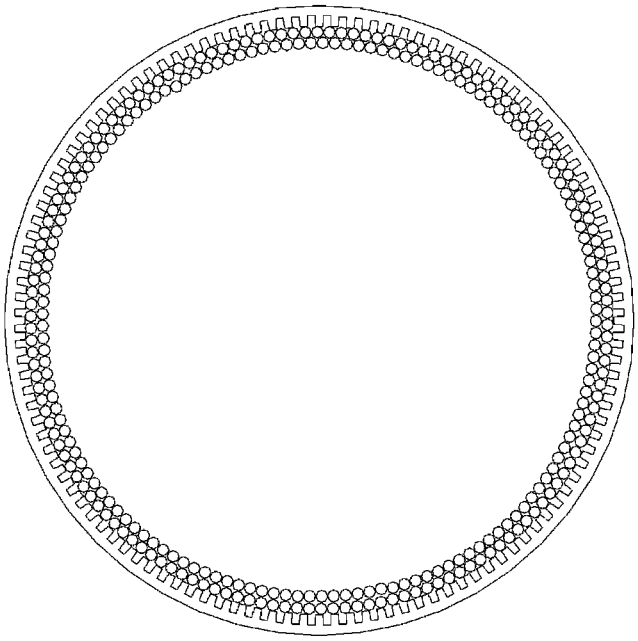
FIG. 23 shows a heat pipe structure of the high-power LED lamp.

Referring to FIG. 23, each of the heat pipes of the first and second heat pipe assemblies 303, 304 has a tubular configuration. Sintered heat pipes are selected as a preferred choice of the heat pipes and are manufactured by Yeh-Chiang Technology. The sintered heat pipes each have grooves defined in an inner surface thereof. A number of the grooves defined in each of the sintered heat pipes is greater than 120. To be fit for a high-power illumination, each of the sintered heat pipes has a thermal resistance less than 0.05° C./watt. The heat pipes are flattened so as to have a good contact with related components, thereby achieving a good heat-dissipation effect.

Figure 22:
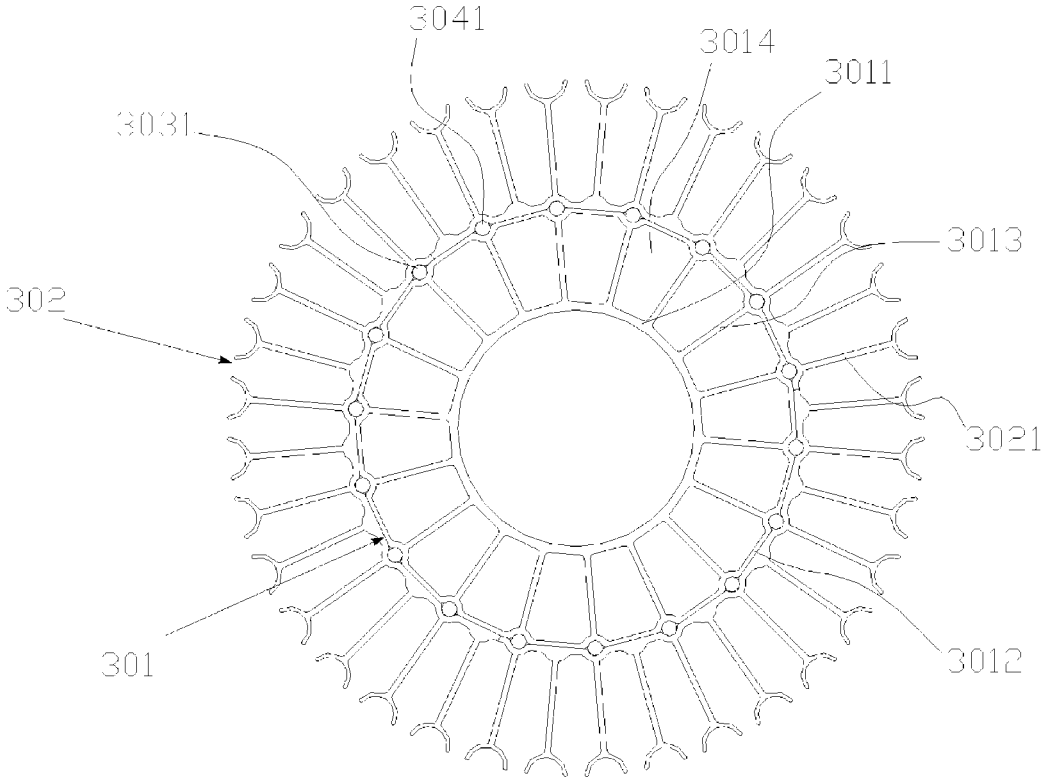
FIG. 22 shows a cross section of the assembly of the first heat pipe assembly, the second heat pipe assembly, the inner heat sink and the outer heat sink of the high-power LED lamp.

According to the structure described above, the annular and grid-shaped configuration formed by the straight sections of the first and second heat pipe assemblies 303, 304 is coiled around the inner heat sink 301 and contacts with an outer wall of the outer cylinder 3012 of the inner heat sink 301. At the same time, the annular and grid-shaped configuration contacts with an inner surface of the hole 3020, viewed from FIG. 22.

As a preferred embodiment, the outer wall of the outer cylinder 3012 of the inner heat sink 301 defines a plurality of first grooves 3015 along the axial direction of the inner heat sink 301. The first grooves 3015 receive the straight sections of the first and second heat pipe assemblies 303, 304 therein. The straight sections of the first and second heat pipe assemblies 303, 304 are tightly secured in the first grooves 3015. Each of the first grooves 3015 has an arc-shaped cross section.

Each of the heat pipes of the first and second heat pipe assemblies 303, 304 has an arc-shaped face corresponding to the first groove 3015.

Similarly, a circumferential surface corresponding to the hole 3020 of the outer heat sink 302 preferably defines a plurality of second grooves 3016 along the axial direction of the outer heat sink 302. The second grooves 3016 receive the straight sections of the first and second heat pipe assemblies 303, 304 therein. The straight sections of the first and second heat pipe assemblies 303, 304 are tightly secured in the second grooves 3016. Each of the second grooves 3016 has an arc-shaped cross section. Each of the heat pipes of the first and second heat pipe assemblies 303, 304 has an arc-shaped face corresponding to the second grooves 3016.

Therefore, in a situation of not changing the shape of the heat pipes and simplifying the process, the heat pipes secure the inner heat sink 301 and the outer heat sink 302 to achieve an ideal position and a compact construction. In addition, the arc-shaped combination between the heat pipes and the inner, outer heat sink 301, 302 increases the contact area and further increases an effective heat-conduction area therebetween, thereby achieving optimal heat conduction.

In addition, in order to improve the cooling efficiency of the inner heat sink 301 and the outer heat sink 302, as a preferred solution, each of the fins 3013 has a side thereof connected to a position close to a corresponding first groove 3015 so that the heat transferred from the heat pipes is transferred to the fins 3013 in the most short distance and is dissipated via the heat exchange between the fins 3013 and the ambient air. Similarly, each of the fins 3021 has a side thereof connected to a position close to a corresponding second groove 3016 so that the heat transferred from the heat pipes is transferred to the fins 3021 in the most short distance and is dissipated via the heat exchange between the fins 3021 and the ambient air.

The heat-dissipation solution of the present invention may be used in all kinds of high-power LED lamps. The main heat source of the high-power LED lamp is the heat generated by the LED module 320. When the LED module 320 is working, the heat generated by the LED module 320 is transferred to the smooth surface 3030 of the first heat pipe assembly 303 and is absorbed by the first heat pipe assembly 303. Due to the contact between the first heat pipe assembly 303 and the second heat pipe assembly 304, the second heat pipe assembly 304 shares the heat with the first heat pipe assembly 303. The heat absorbed by the middle sections of the first heat pipe assembly 303 is transferred to the straight sections of the first heat pipe assembly 303, and the heat absorbed by the middle sections of the second heat pipe assembly 304 is transferred to the straight sections of the second heat pipe assembly 304. Due to the contact between the straight sections of the first, second heat pipe assembly 303, 304 and the outer wall of the outer cylinder 3012 of the inner heat sink 301 and the contact between the straight sections of the first, second heat pipe assembly 303, 304 and the circumferential surface corresponding to the hole 3020 of the outer heat sink 302, the heat is transferred to the inner heat sink 301 and the outer heat sink 302 along two paths. The inner heat sink 301 and the outer heat sink 302 cooperatively dissipate the heat. In order to achieve a good heat dissipation, the sum of the power of the first and second heat pipe assemblies 303, 304 is larger than or equal to the power of the LED module 320 so that the heat-dissipation speed of the first and second heat pipe assemblies 303, 304 keeps up with the heat-generation speed of the LED module 320.

Figure 24:
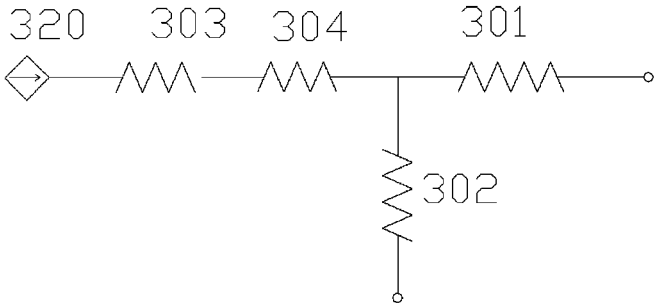
FIG. 24 shows an equivalent heat-dissipation path of the high-power LED lamp of FIG. 14.

According to the structure described above, the present invention may be used in a super-power LED lamp. FIG. 24 shows an equivalent heat-dissipation path of the present invention. A heat-conduction line of the LED module 320 is shown as follows: firstly, the heat generated by the LED module 320 is transferred to the first and second heat pipe assemblies 303, 304 through a heat-conduction element. The first and second heat pipe assemblies 303, 304 may be equivalent to a heat superconductor rapidly conducting the heat. The heat absorbed by the first and second heat pipe assemblies 303, 304 is transferred in two heat-dissipation paths: one path is transferred to the inner heat sink 301, and then the heat is dissipated by the inner heat sink 301 via the heat exchange between the inner heat sink 301 and the ambient air; the other path is transferred to the outer heat sink 302, and then the heat is dissipated by the outer heat sink 302 via the heat exchange between the outer heat sink 302 and the ambient air. Therefore, the inner heat sink 301 and the outer heat sink 302 are equivalent to two parallel heat-dissipation portions. The high-power LED lamp has an ideal heat dissipation because the heat-dissipation paths are disposed for only one LED module 320.

After installation of the high-power LED lamp, a side of the high-power LED lamp with the LED module 320 faces down for illuminating. The high-power LED lamp disposes a cover 8 covering the LED lamp 320. A cold air flows upwardly from the side close to the LED module 320 into the air passages of the inner heat sink 301 and the outer heat sink 302 and carries away the heat absorbed by the inner heat sink 301 and the outer heat sink 302 to be changed a hot air, and then the hot air flows away from an upward side of the air passages. By this cycle, it may achieve a good heat dissipation.

Figure 25:
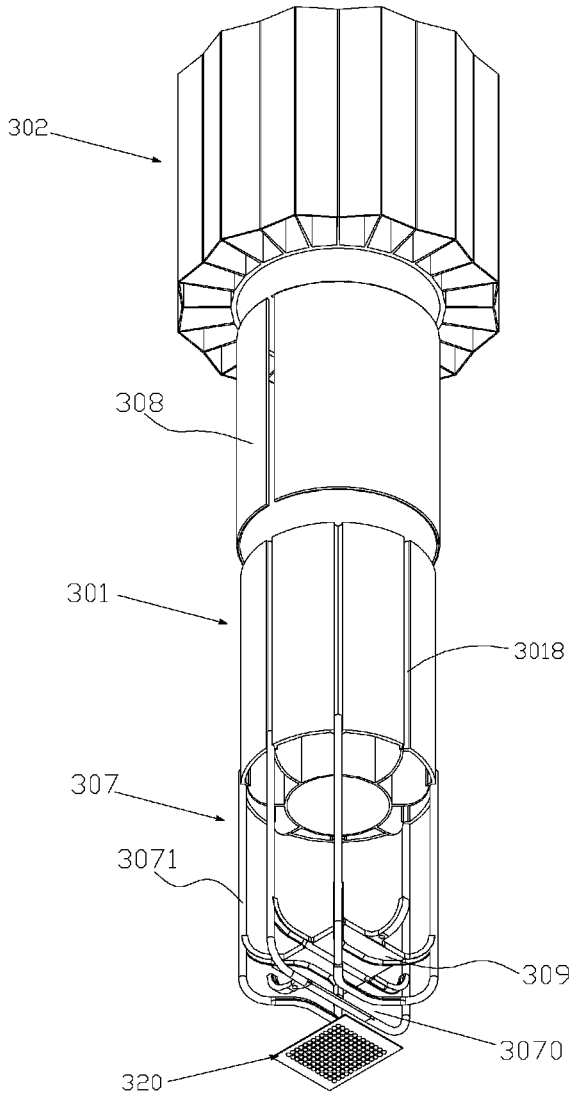
FIG. 25 shows an exploded structure of the high-power LED lamp according to a second embodiment of the present invention.
Figure 26:
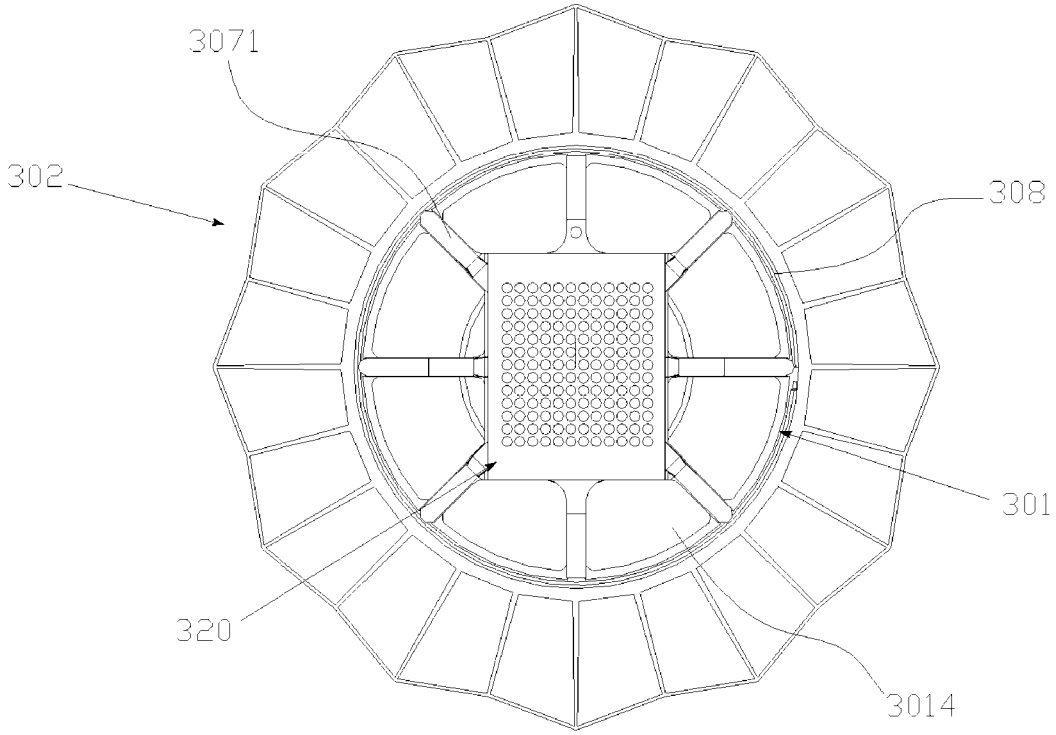
FIG. 26 shows a front view of the high-power LED lamp of FIG. 25.

Referring to FIGS. 25-26, the high-power LED lamp is illustrated according to another typical embodiment. The high-power LED lamp includes an LED module 320, an inner heat sink 301, a heat pipe assembly 307, a vapor chamber 308, and an outer heat sink 302.

The LED module 320 is a high-power element. The LED module 320 includes a base and a plurality of LEDs packaging on the base. The heat generated by the LEDs must be dissipated in time. The base may be taken as a fixed structure and may be taken as a circuit structure of the LED module 320. The base is used for conducting the heat to the heat pipe assembly 307.

The heat pipe assembly 307 is taken as a heat-conduction component in order to dissipate the heat generated by the LED module 320 rapidly and effectively. The heat pipe assembly 307 includes a plurality of heat pipes 3071. Sintered heat pipes are selected as a preferred choice of the heat pipes 3071 and are manufactured by Yeh-Chiang Technology. The sintered heat pipes each have grooves defined in an inner surface thereof. A number of the grooves defined in each of the sintered heat pipes is greater than 120. To be fit for a high-power illumination, each of the sintered heat pipes has a thermal resistance less than 0.05° C./watt. The heat pipes assembly 307 has each of the heat pipes 3071 bent into a U-shaped configuration and put multiple heat pipes together. The heat pipes 3071 are flattened so as to have a good contact with related components, thereby achieving a good heat-dissipation effect.

Each of the heat pipes 3071 includes three sections, namely two straight sections and a middle section between the straight sections. The middle sections of the U-shaped heat pipes 3071 are put or soldered together to cooperatively form a smooth surface 3070 for securing the LED module 320 thereon. The straight sections of the U-shaped heat pipes 3071 are located a side of the smooth surface 3070 and are distributed along a circumference of the smooth surface 3070 to form a grid-shaped configuration. The grid-shaped configuration is disposed outside of the inner heat sink 301 and contacts with an outer wall of the inner heat sink 301, whereby the heat absorbed by the smooth surface 3070 is transferred to the grid-shaped configuration, and then is transferred to the inner heat sink 301. The heat is dissipated by the inner heat sink 301.

Various mating parts of the high-power LED lamp, for example, a power supply, may be disposed in the inner heat sink 301 so that the mating parts are hid in the inner heat sink 301. Wires extend from an interior of the inner heat sink 301 and are connected to pins or the base of the LED module 320.

Figure 27:
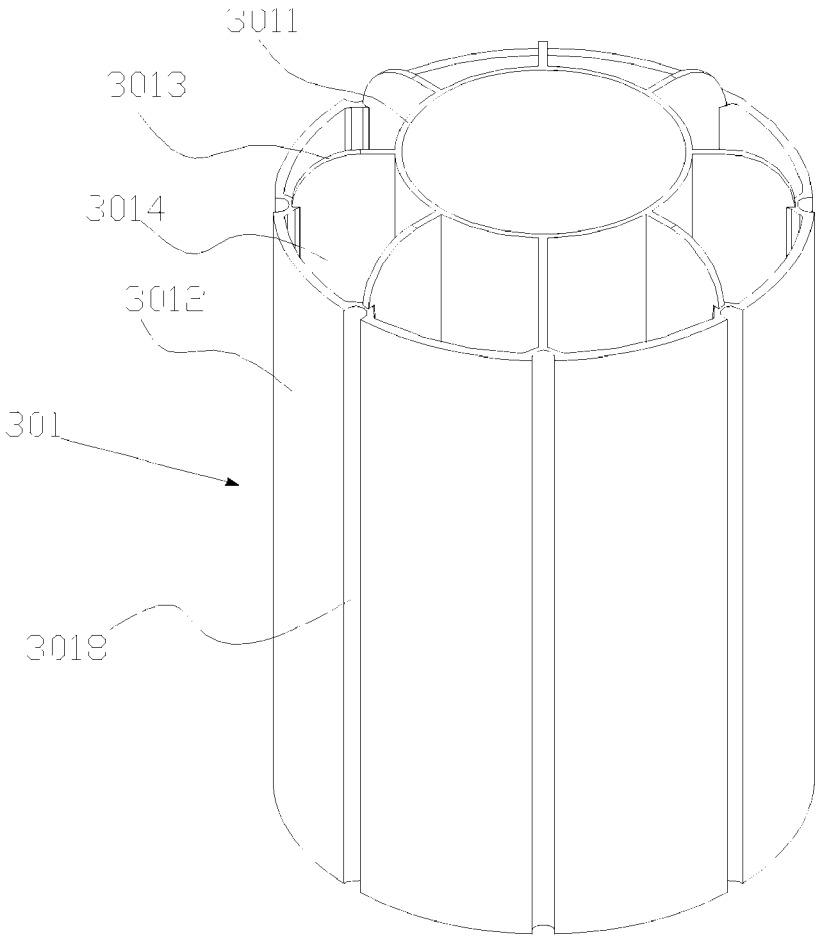
FIG. 27 shows a view of an inner heat sink of the high-power LED lamp of FIG. 25.

Referring to FIG. 27, the inner heat sink 301 includes an inner cylinder 3011 and an outer cylinder 3012 coiling around the inner cylinder 3011. The inner cylinder 3011 and the outer cylinder 3012 are concentric with each other. A plurality of fins 3013 are disposed between the inner cylinder 3011 and the outer cylinder 3012. Air passages 3014 are defined between adjacent fins 3013 and generate the chimney effect due to the heat absorbed by the adjacent fins 3013. In assembly of the high-power LED lamp 300, various mating parts of the high-power LED lamp 300 such as the driving unit 330, the control unit 310 may optionally be disposed in the inner cylinder 3011 so that the mating parts are hid in the inner cylinder 3011. Wires extend from an interior of the inner cylinder 3011 and are connected to pins of the LED module 320 or a metal heat-conduction component. In a preferred embodiment, a plurality of extending holes 3017 are defined in the inner cylinder 3011 of the inner heat sink 301 and allow the air which flows into the interior of the inner cylinder 3011 to pass therethrough into the air passages 3014 and near the fins 3013, for improving the heat dissipation of the high-power LED lamp. After assembly of the inner heat sink 301 and the heat pipe assembly 307, the smooth surface 3070 formed by the heat pipe assembly 307 is located at an end of the heat pipe assembly 307 to ensure the smooth surface 3070 and the LED module 320 attached to the smooth surface 3070 not to block the air passages 3014 of the inner heat sink 301. After the inner heat sink 301 absorbs the heat on the heat pipe assembly 307, the air passages 3014 generate a chimney effect to dissipate the heat well. In actual products, the grid-shape configuration formed by the heat pipe assembly 307 has an equal space between the straight sections of the heat pipe assembly 307, and the air passages 3014 of the inner heat sink 301 also have an equal space so that the heat is dissipated evenly.

Figure 28:
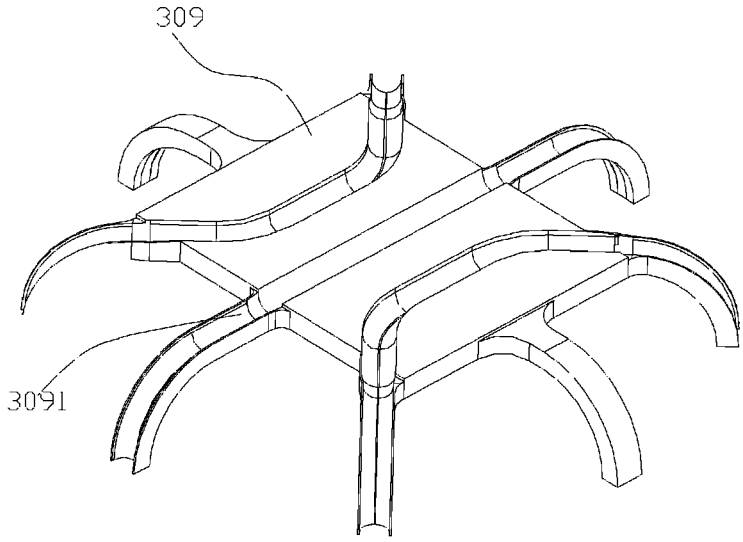
FIG. 28 shows a view of a supporting frame of the high-power LED lamp of FIG. 25.

As a preferred solution, a supporting frame 309 supporting for the heat pipe assembly 307 is disposed between the smooth surface 3070 and the inner heat sink 301, viewed from FIG. 28. A group of grooves 3091 is defined in a bottom surface of the supporting frame 309 to receive the middle sections of the heat pipe assembly 307 therein. A top surface of the supporting frame 309 is tightly contact with the inner heat sink 301. The supporting frame 309 favors the heat conduction and can make the integral structure more stable and reasonable as a middle element.

The vapor chamber 308 has an annular configuration. An inner wall of the vapor chamber 308 contacts with the straight section of each heat pipe 3071, for achieving a better heat conduction. The heat on the heat pipe 3071 is transferred to the vapor chamber 308 except for the inner heat sink 301. The outer heat sink 302 absorbs the heat on the vapor chamber 308 and dissipates the heat to the ambient air.

The heat pipe 3071 has a tubular configuration. The heat pipes assembly 307 has each of the heat pipes 3071 bent into a U-shaped configuration and put multiple heat pipes together. The heat pipe assembly 307 has the smooth surface 3070 and the grid-shaped configuration, and the heat pipes are further flattened so as to have a good contact with related components, thereby achieving a good heat-dissipation effect. In a preferred solution, the outer wall of the inner heat sink 301 defines a plurality of grooves 3018 therein, and the grooves 3018 extend along an axial direction of the inner heat sink 301. The straight sections of the heat pipe assembly 307 are received in the grooves 3018. The straight sections of the heat pipe assembly 307 are tightly secured in the second grooves 3018. Each of the second grooves 3018 has an arc-shaped cross section, and each of the heat pipes 3071 of the heat pipe assembly 307 has an arc-shaped face corresponding to the second grooves 3018, thereby obtaining a tight combination.

Figure 29:
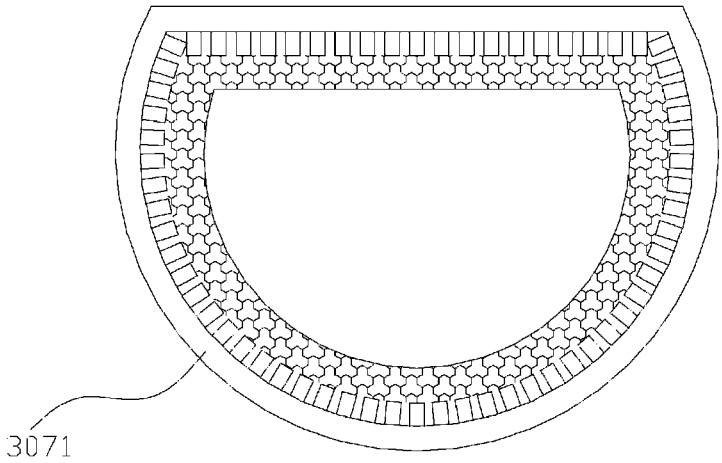
FIG. 29 shows a cross section of a heat pipe of the high-power LED lamp of FIG. 25.

Therefore, in a situation of not changing the shape of the heat pipes and simplifying the process, the heat pipes not only secure the inner heat sink 301 thereon, but also tightly combine with the inner heat sink 301, for achieving an optimal heat conduction. Referring to FIG. 29, the heat pipe 3071 has a side thereof flattened to contact with the inner wall of the vapor chamber 308. The arc-shaped side of the heat pipe 3071 is received in the groove 3018.

Figure 30:
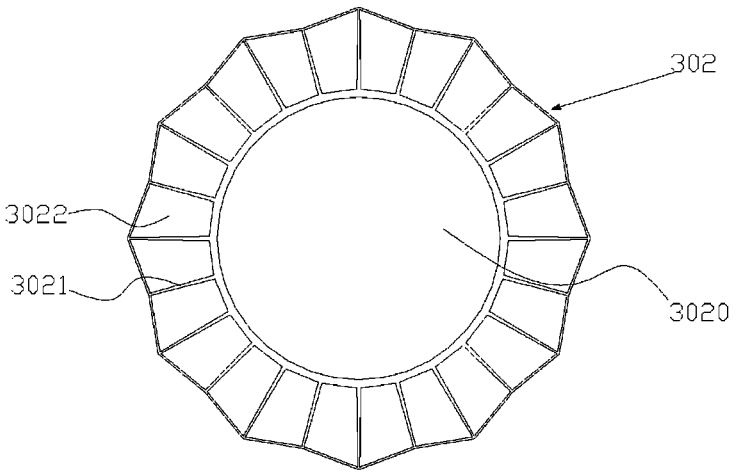
FIG. 30 shows a view of an outer heat sink of the high-power LED lamp of FIG. 25.

The heat absorbed by the vapor chamber 308 is dissipated by the outer heat sink 302. The bigger contact area between the outer heat sink 302 and the ambient air, the better heat dissipation obtained. Referring to FIG. 30, the outer heat sink 302 has a hole 3020 defined therein. The outer heat sink 302 disposes a heat-dissipation structure in a circumference thereof. The heat-dissipation structure extends along an axial direction of the outer heat sink 302. The heat-dissipation structure has a large contact area with an ambient air, for improving the cooling effect. A plurality of air passages 3022 are defined in a circumference of the outer heat sink 302, extend along an axial direction of the outer heat sink 302, and generate the chimney effect due to the heat conducted by the inner heat sink 301 and the vapor chamber 308, thereby raising the speed of air flow and realizing a rapid heat conduction. In the design and manufacturing, the outer heat sink 302 may include a first cylinder and a second cylinder concentric with the first cylinder. The first cylinder has a diameter larger than the second cylinder. The first cylinder is coiled around the second cylinder. A plurality of fins 3021 radially extend from a circumference of the first cylinder to a circumference of the second cylinder. The second cylinder defines a through hole therein. The inner heat sink 301 and the gird-shaped configuration formed by the heat pipe assembly 307 are received in the through hole of the second cylinder. The air passages 3022 are defined between adjacent fins 3021.

Figure 31:
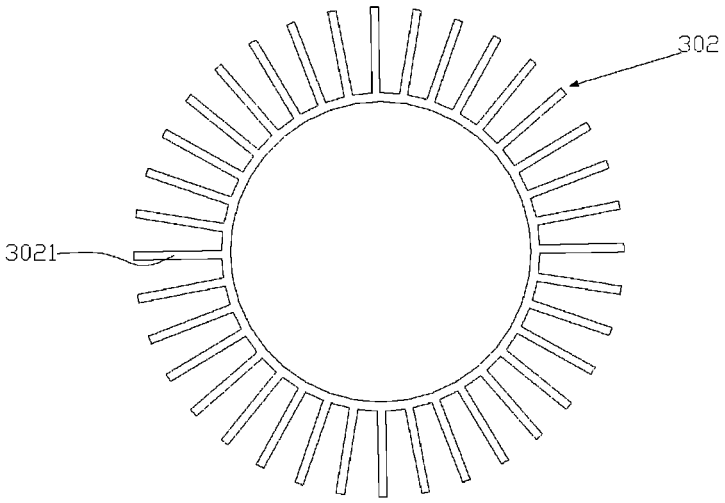
FIG. 31 shows a view of the outer heat sink with another structure of the high-power LED lamp of FIG. 25.

Referring to FIG. 31, as another preferred embodiment, the outer heat sink 302 dispose a plurality of fins 3021 on the circumference thereof. Each of the fins 3021 may be Y-shaped or T-shaped. The fins 3021 may be connected with each other to obtain a large heat-dissipation area, and still have the chimney effect.

Figure 32:
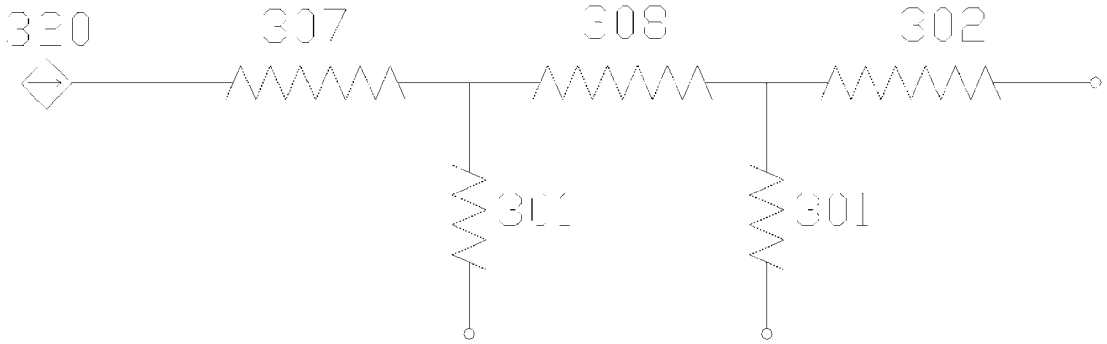
FIG. 32 shows an equivalent heat-dissipation path of the high-power LED lamp of FIG. 25.

According to the structure described above, the present invention may be used in a super-power LED lamp. FIG. 32 shows an equivalent heat-dissipation path of the present invention. A heat-conduction line of the LED module 320 is shown as follows: firstly, the heat generated by the LED module 320 is transferred to the heat pipe assembly 307 and the vapor chamber 308. The heat pipe assembly 307 may be equivalent to a heat superconductor rapidly conducting the heat. The heat absorbed by the heat pipe assembly 307 is transferred in two heat-dissipation paths: one path is transferred to the inner heat sink 301, and then the heat is dissipated by the inner heat sink 301 via the heat exchange between the inner heat sink 301 and the ambient air; the other path is transferred to the outer heat sink 302 through the vapor chamber 308, and then the heat is dissipated by the outer heat sink 302 via the heat exchange between the outer heat sink 302 and the ambient air. Therefore, the inner heat sink 301 and the outer heat sink is 302 are equivalent to two parallel heat-dissipation portions. The high-power LED lamp has an ideal heat dissipation because the heat-dissipation paths are disposed for only one LED module 320.

After installation of the high-power LED lamp, a side of the high-power LED lamp with the LED module 320 faces down for illuminating. A cold air flows upwardly from the side close to the LED module 320 into the air passages of the inner heat sink 301 and/or the outer heat sink 302 and carries away the heat absorbed by the inner heat sink 301 and/or the outer heat sink 302 to be changed a hot air, and then the hot air flows away from an upward side of the air passages. By this cycle, it may achieve good heat dissipation.

Therefore, the present invention provides a high-power LED lamp and an LED lighting system.

Finally, the above-discussion is intended to be merely illustrative of the disclosure and should not be construed as limiting the appended claims to any particular embodiment or group of embodiments. Thus, while the disclosure has been described with reference to exemplary embodiments, it should also be appreciated that numerous modifications and alternative embodiments may be devised by those having ordinary skill in the art without departing from the broader and intended spirit and scope of the disclosure as set forth in the claims that follow. In addition, the section headings included herein are intended to facilitate a review but are not intended to limit the scope of the present system. Accordingly, the specification and drawings are to be regarded in an illustrative manner and are not intended to limit the scope of the appended claims.

What is claimed is:

1. An LED lighting system comprising:

a high-power LED lamp, the high-power LED lamp comprising:

a control unit receiving a lighting instruction and outputting a control signal according the lighting instruction;

an LED module comprising a base and a plurality of LED chips disposed on the base;

a driving unit connected to the control unit and outputting a current with a corresponding intensity according to the control signal to drive the LED module;

an inner heat sink comprising an inner cylinder and an outer cylinder coiling around the inner cylinder, the inner cylinder and the outer cylinder being concentric with each other, a plurality of fins being disposed between the inner cylinder and the outer cylinder, air passages being defined between adjacent the fins and generating a chimney effect due to heat absorbed by adjacent the fins;

an outer heat sink having a hole defined therein and disposing a plurality of fins surrounding the hole and extending along an axial direction of the outer heat sink, air passages being defined between adjacent the fins and generating the chimney effect due to heat absorbed by adjacent the fins, the outer heat sink being coiled around the inner heat sink;

a first heat pipe assembly including a plurality of U-shaped heat pipes, middle sections of the heat pipes being put together to cooperatively form a smooth surface for securing the LED module thereon, straight sections of the heat pipes being coiled around the inner heat sink and being attached to an outer surface of the outer cylinder of the inner heat sink and a circumferential surface corresponding to the hole of the outer heat sink;

a second heat pipe assembly including a plurality of U-shaped heat pipes, middle sections of the second heat pipe assembly being located a rear side of the middle sections of the first heat pipe assembly, the middle sections of the second heat pipe assembly being substantially perpendicular to the middle sections of the first heat pipe assembly, straight sections of the second heat pipe assembly being coiled around the inner heat sink and being attached to the outer surface of the outer cylinder of the inner heat sink and the circumferential surface corresponding to the hole of the outer heat sink, and a supporting board being located between the middle sections of the first heat pipe assembly and the middle sections of the second heat pipe assembly, the supporting board having a first set of grooves defined in a first surface and a second set of grooves defined in a second surface, the first set of grooves receiving and locking the middle sections of the first heat pipe assembly therein; the second set of grooves receiving and locking the middle sections of the second heat pipe assembly therein, the supporting board defining a plurality of through holes so that the middle sections of the first and second heat pipe assembly contact with each other through the through holes, wherein a sum of a power of the first and second heat pipe assemblies is greater than or equal to a power of the LED module.

2. The LED lighting system as claimed in claim 1, wherein an outer wall of the outer cylinder of the inner heat sink defines a plurality of first grooves extending along an axial direction of the inner heat sink, the straight sections of the heat pipes are secured in the first grooves, each of the first grooves has an arc-shaped cross section, each of the heat pipes has an arc-shaped face corresponding to the first groove.

3. The LED lighting system as claimed in claim 1, wherein the circumferential surface corresponding to the hole of the outer heat sink defines a plurality of second grooves along the axial direction of the outer heat sink, the straight sections of the heat pipes are secured in the second grooves, each of the second grooves has an arc-shaped cross section, each of the heat pipes has an arc-shaped face corresponding to the second groove.

4. The LED lighting system as claimed in claim 2, wherein a plurality of fins are disposed at a position close to the first grooves of the inner heat sink.

5. The LED lighting system as claimed in claim 3, wherein a plurality of fins are disposed at a position close to the second grooves of the outer heat sink.

6. The LED lighting system as claimed in claim 1, wherein each of the U-shaped heat pipes is bent from a single heat pipe or is pieced together from two L-shaped heat pipes.

7. The LED lighting system as claimed in claim 1, wherein a plurality of extending holes are defined in the inner cylinder of the inner heat sink and allow air flowing therethrough.

8. The LED lighting system as claimed in claim 1 further comprising an additional supporting board disposed at a rear side of the second heat pipe assembly, wherein the additional supporting board has a set of grooves defined therein, the middle sections of the second heat pipe assembly being secured in the grooves.

9. The LED lighting system as claimed in claim 1, wherein the heat pipes are sintered heat pipes each having grooves defined in an inner surface thereof.

10. The LED lighting system as claimed in claim 9, wherein a number of the grooves defined in each of the sintered heat pipes is greater than 120, a width between adjacent grooves is less than 0.1.

11. The LED lighting system as claimed in claim 10, wherein each of the sintered heat pipes has a thermal resistance less than 0.05° C./watt.

12. The LED lighting system as claimed in claim 1 further comprising a remote control equipment used to output an instruction signal and a communications network receiving the instruction signal from the remote control equipment and outputting a lighting instruction according to the instruction signal, the control unit receiving the lighting instruction and outputting the control signal according the lighting instruction, the driving unit outputting the current with a corresponding intensity according to the control signal to drive the LED module.

13. The LED lighting system as claimed in claim 12, wherein the LED module comprises three primary color LED chips including a red LED chip, a green LED chip, and a blue LED chip, the high-power LED lamp further comprises three color temperature drive circuits respectively connected to the red LED, the green LED and the blue LED chips, the color temperature drive circuits output current with a corresponding intensity according to the control signal of the control unit to drive the red LED, the green LED and the blue LED chips for adjusting the color temperature of the LED module.

14. The LED lighting system as claimed in claim 12, wherein the high-power LED lamp further comprises a direction-adjusting device, the direction-adjusting device comprises a direction-adjusting motor and a transmission module, the direction-adjusting motor is connected to the control unit and adjusts the direction of the high-power LED lamp according a control signal of the control unit via the transmission module.

15. The LED lighting system as claimed in claim 12, wherein the high-power LED lamp further comprises a lens transmitting light of the LED module and an angle-adjusting device adjusting a distance between the LED module and the lens, the angle-adjusting device comprises a motor and a transmission module, the motor is connected to the control unit and adjusts a distance between the lens and the LED module according to a control signal of the control unit via the transmission module.

16. The LED lighting system as claimed in claim 12, wherein the remote control equipment is a mobile phone, a handheld device or a computers.

17. The LED lighting system as claimed in claim 2, wherein a circumferential surface corresponding to the hole of the outer heat sink defines a plurality of second grooves along the axial direction of the outer heat sink, the straight sections of the heat pipes being secured in the second grooves, each of the second grooves has an arc-shaped cross section, each of the heat pipes has an arc-shaped face corresponding to the second groove.

18. The LED lighting system as claimed in claim 17, wherein a plurality of fins are disposed at a position close to the second grooves of the outer heat sink.

* * * * *